US011944205B2

(12) United States Patent
Vester, III et al.

(10) Patent No.: US 11,944,205 B2
(45) **Date of Patent: *Apr. 2, 2024**

(54) CUSTOM FOAM MATTRESS DESIGN SYSTEM

(71) Applicants: John William Vester, III, Westport, CT (US); Robert Henry Zukowski, Shelton, CT (US)

(72) Inventors: John William Vester, III, Westport, CT (US); Robert Henry Zukowski, Shelton, CT (US)

(73) Assignee: CUSTOM SLEEP TECHNOLOGY, LLC, Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/314,884

(22) Filed: May 7, 2021

(65) Prior Publication Data

US 2021/0259435 A1 Aug. 26, 2021

Related U.S. Application Data

(63) Continuation of application No. 16/374,281, filed on Apr. 3, 2019, now Pat. No. 11,006,765.

(60) Provisional application No. 62/652,041, filed on Apr. 3, 2018.

(51) Int. Cl.
*A47C 27/15* (2006.01)
*A47C 27/00* (2006.01)

(52) U.S. Cl.
CPC ..... *A47C 27/15* (2013.01); *A47C 27/001* (2013.01)

(58) Field of Classification Search
CPC ..... A47C 27/00; A47C 27/001; A47C 27/002; A47C 27/04; A47C 27/05; A47C 27/053; A47C 27/056; A47C 27/15
See application file for complete search history.

(56) References Cited

U.S. PATENT DOCUMENTS

| | | | | |
|---|---|---|---|---|
| 3,521,311 A | | 7/1970 | Cohen | |
| 3,846,857 A | * | 11/1974 | Weinstock | A47C 27/15 5/722 |
| 4,985,951 A | * | 1/1991 | Lacotte | A47C 27/15 5/951 |
| 4,999,868 A | | 3/1991 | Kraft | |
| 5,148,706 A | | 9/1992 | Masuda et al. | |
| 6,192,538 B1 | | 2/2001 | Fogel | |
| 6,286,166 B1 | | 9/2001 | Henley et al. | |

(Continued)

FOREIGN PATENT DOCUMENTS

GB 1445561 A 8/1976

*Primary Examiner* — Justin C Mikowski
*Assistant Examiner* — George Sun
(74) *Attorney, Agent, or Firm* — Farber LLC; Jonathan Adam Winter

(57) ABSTRACT

A custom mattress having an upper layer and a lower layer. The upper layer has two or more segments arranged such that a first segment is positioned at a head of the mattress and a second segment is positioned adjacent the first segment at a first transition point. The lower layer has two or more segments arranged such that a third segment is positioned at the head of the mattress and a fourth segment is positioned adjacent the third segment at a second transition point that is offset a distance from the first transition point, the distance being measured along a longitudinal axis of the mattress. Each of the segments have different densities.

18 Claims, 5 Drawing Sheets

(56) References Cited

U.S. PATENT DOCUMENTS 6,585,328 B1 7/2003 Oexman et al.
6,807,698 B2 * 10/2004 Torbet ..... A47C 27/082 5/730
6,993,800 B2 2/2006 Greenawalt et al.
8,117,700 B2 * 2/2012 Howard ..... G06Q 30/0621 5/690
8,359,689 B2 1/2013 Warren et al.
9,433,302 B2 9/2016 Mojtabavi
9,820,582 B2 11/2017 Rawls-Meehan et al.
9,854,922 B1 * 1/2018 Schiller ..... A47C 27/15
9,962,008 B1 5/2018 Omiste
11,006,765 B2 * 5/2021 Vester, III ..... A47C 27/148
2007/0022540 A1 * 2/2007 Hochschild ..... A47C 27/001 5/738
2008/0072382 A1 * 3/2008 James ..... A47C 27/04 5/717
2008/0098533 A1 * 5/2008 Erdman ..... A47C 27/001 5/722
2008/0201856 A1 * 8/2008 Howard ..... A47C 31/123 5/690
2008/0301983 A1 * 12/2008 Murphy ..... G09F 23/00 5/690
2009/0139034 A1 6/2009 Maarbjerg
2010/0170042 A1 7/2010 Rose
2010/0229302 A1 * 9/2010 De Bock ..... A47C 31/006 5/248
2012/0124753 A1 * 5/2012 Lee ..... A47C 27/15 29/428
2013/0263377 A1 10/2013 Wootten, Jr.
2014/0201925 A1 * 7/2014 Tursi, Jr. ..... A47C 27/14 5/722
2015/0296993 A1 * 10/2015 Boyd ..... A47C 27/001 5/724
2015/0320228 A1 11/2015 Kilgore et al.
2016/0015185 A1 * 1/2016 Khambete ..... A47C 27/125 5/737
2016/0244319 A1 8/2016 Habertag et al.
2016/0353907 A1 12/2016 Lava et al.
2017/0035211 A1 * 2/2017 Alletto, Jr. ..... A47C 27/07
2017/0224126 A1 * 8/2017 O'Connell, Jr. ..... A47G 9/10
2018/0168362 A1 * 6/2018 Dorfman ..... A47C 31/123
2018/0279795 A1 10/2018 Murphy et al.
2019/0021512 A1 1/2019 Machado

* cited by examiner

CUSTOM FOAM MATTRESS DESIGN SYSTEM

FIELD OF THE INVENTION

The present invention relates to the field of mattress design, construction, assembly, and operation.

BACKGROUND OF THE INVENTION

Traditional spring mattresses have been the mattress standard for sleeping in developed countries for over a century. Foam mattresses made of a slab of foam, often shipped compressed, rolled up, and delivered to the customer have been in existence for at least a decade.

Currently, mattresses have been constructed to primarily create a single density, or feel, on the mattress surface. Although some mattresses are constructed with multiple densities, these are not custom designed to a specific user, but rather attempt to accommodate various parts of the user's body with a "one size fits all" approach. Users of these mattresses move various pieces of foam of different density, either physically or mechanically (e.g. by adding air into a bladder), to accommodate the user's desired surface feel.

It is known in the industry that optimal sleep is enabled when a sleeper's spine is in alignment, because no undue pressure is created in the sleeper's spine when it is in its natural curvature. Optimal sleep provides restful, rejuvenating, and healthy sleep, which all people require, and is best achieved when the sleeper's spine is in proper alignment. The currently available multiple density mattresses do not achieve optimal spinal alignment because the "one size fits all" approach fails to account for each user's unique body characteristics.

What is needed, therefore, is a custom mattress and systems and methods of designing a custom mattress that uses a sleeper's unique body characteristics and preferred sleep position to create a complex sleep surface that provides optimal support for the sleeper at all points where the sleeper's body touches the mattress.

SUMMARY OF THE INVENTION

Therefore, it is an object of the present invention to provide a sleeping surface having multiple layers and segments of foam of different densities to collectively achieve the appropriate amount of support under a sleeper at the various key pressure points to achieve optimal spinal alignment and appropriate surface pressure for the sleeper's weight while in the sleeper's preferred sleep position.

This and other objects of the present invention are achieved by providing a custom mattress having an upper layer and a lower layer. The upper layer has two or more segments arranged such that a first segment is positioned at a head of the mattress and a second segment is positioned adjacent the first segment at a first transition point. The lower layer has two or more segments arranged such that a third segment is positioned at the head of the mattress and a fourth segment is positioned adjacent the third segment at a second transition point that is offset a distance from the first transition point, the distance being measured along a longitudinal axis of the mattress. Each of the segments have different densities.

In some embodiments, each of the two or more segments of the upper layer are separate from each other and are removable from the mattress.

In some embodiments, each of the two or more segments of the lower layer are separate from each other and are removable from the mattress.

In some embodiments, the distance that the second transition point is offset from the first transition point is in the range of about 20% to about 40% of a length of the first segment.

In some embodiments, the distance that the second transition point is offset from the first transition point is in the range of about 60% to about 90% of a length of an intended user's hip bone.

In some embodiments, each of the segments is formed of a foam material enclosed in a physically-coded cover.

In some embodiments, the custom mattress further includes a sealable case for retaining the mattress.

In some embodiments, the custom mattress further includes a base layer having at least one removable segment. In other embodiments, the base layer includes at least two sub-layers each having at least one removable segment.

In some embodiments, the mattress is configured to be arranged adjacent to a matching mattress having third and fourth transition points. The mattress and the matching mattress being retainable within a sealable case. In other embodiments, the positioning of the first and second transition points is determined by a first intended user's body characteristics, and the positioning of the third and fourth transition points is determined by a second intended user's body characteristics.

In an alternative embodiment of the present invention, a custom sleep system having a mattress and a sealable case for retaining the mattress is provided. The mattress has first and second lateral sections. The first lateral section includes a first upper layer, a first lower layer, and a first base layer. The first upper layer has a plurality of removable segments arranged such that a first removable segment is positioned at a head of the mattress and a second removable segment is positioned adjacent the first removable mattress at a first transition point determined by a first intended user's body characteristics. The first lower layer has a plurality of removable segments arranged such that a third removable segment is positioned at the head of the mattress and a fourth removable segment is positioned adjacent the third removable segment at a second transition point that is offset a first distance from the first transition point. The first base layer has at least one removable segment. The second lateral section includes a second upper layer, a second lower layer, and a second base layer. The second upper layer has a plurality of removable segments arranged such that a fifth removable segment is positioned at the head of the mattress and a sixth removable segment is positioned adjacent the fifth removable segment at a third transition point determined by a second intended user's body characteristics. The second lower layer has a plurality of removable segments arranged such that a seventh removable segment is positioned at the head of the mattress and an eighth removable segment is positioned adjacent the seventh removable segment at a fourth transition point that is offset a second distance from the third transition point. The second base layer has at least one removable segment. The first and second distances are each measured along a longitudinal axis of the mattress. Each of the removable segments of the first lateral section of the mattress have different densities that are determined by the first intended user's body characteristics and preferred sleep position. Each of the removable segments of the second lateral section of the mattress have different densities that are determined by the second intended user's body characteristics and preferred sleep position.

In some embodiments, the first and second base layers each include at least two sub-layers each having at least one removable segment.

In some embodiments, the custom sleep system further includes a plurality of custom pillows. At least one of the plurality of custom pillows is designed according to the first intended user's body characteristics and preferred sleep position, and at least another one of the plurality of custom pillows is designed according to the second intended user's body characteristics and preferred sleep position.

In another embodiment of the present invention, a method of assembling a custom mattress is provided. The method includes the steps of inserting a lower foam layer into a case, placing an upper foam layer onto the lower foam layer, and sealing the case. The lower foam layer has at least a first removable segment positioned at a head of the case and a second removable segment adjacent the first removable segment at a first lower transition point. The upper foam layer has at least a third removable segment positioned at the head of the case and a fourth removable segment adjacent the third removable segment at a first upper transition point that is offset a distance from the first lower transition point. The distance being measured along a longitudinal axis of the case. Each of the removable segments have different densities that are determined by a first intended user's body characteristics and preferred sleep position, and each of the removable segments are enclosed in respective physically-coded covers.

In some embodiments, the positioning of the first upper and first lower transition points is determined by the first intended user's body characteristics.

In some embodiments, the method further includes the step of inserting a base foam layer beneath the lower foam layer. The base foam layer has at least one removable segment. In other embodiments, the base foam layer includes at least two sub-layers each having at least one removable segment.

In some embodiments, before the sealing step, the method further includes the step of placing a matching mattress into the case adjacent the mattress. The matching mattress having second upper and second lower transition points. In other embodiments, the positioning of the first upper and first lower transition points is determined by the first intended user's body characteristics, and the positioning of the second upper and second lower transition points is determined by a second intended user's body characteristics.

DETAILED DESCRIPTION OF THE INVENTION

Figure 1:
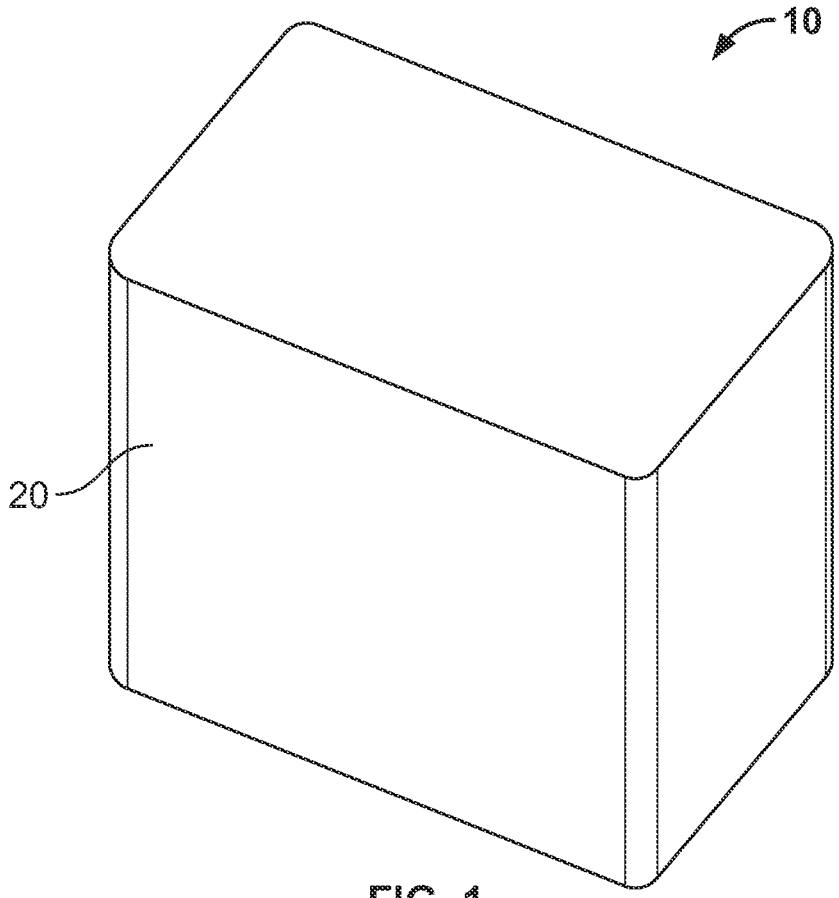
FIG. 1 is a perspective view of a custom mattress enclosed in a mattress cover according to an embodiment of the present invention.

Like a custom-made suit of clothes created by a master tailor to perfectly fit its wearer's unique body characteristics, the present invention provides users with a custom-made mattress constructed to match their unique body specifications and preferred sleep position to provide the users with optimal sleep.

Referring now to the drawings, wherein like reference numerals designate corresponding structure throughout the views. The following examples are presented to further illustrate and explain the present invention and should not be taken as limiting in any regard.

Figure 2:
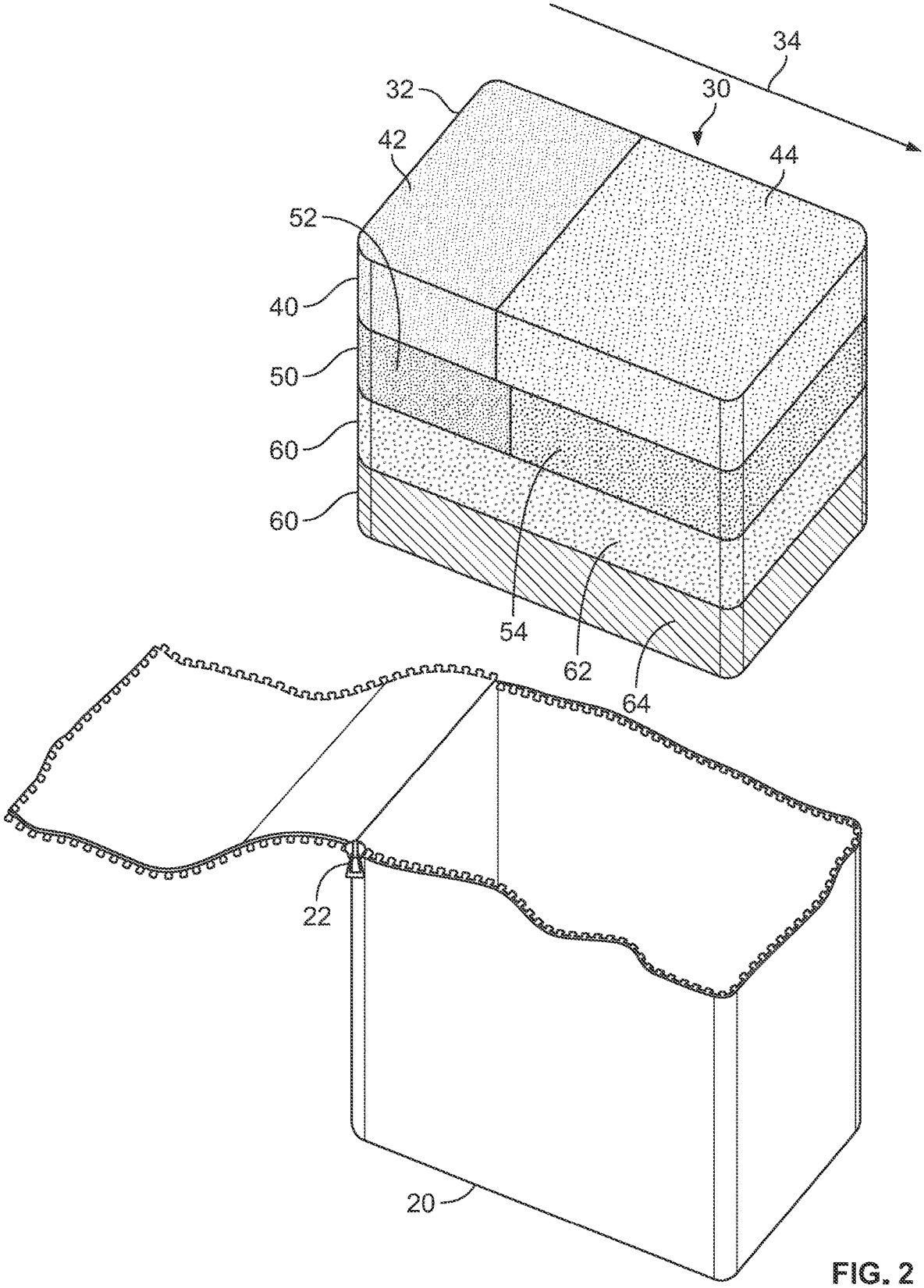
FIG. 2 is a partially exploded view of the custom mattress and mattress cover of FIG. 1.

FIGS. 1-2 show a custom sleep system 10 having a custom mattress 30 that can be retained within a mattress case 20. Preferably, the mattress case 20 is formed of a heavy-duty fabric having elasticity and is sized to fit tightly over the custom mattress 30. The mattress case 20 can be sealed with any fastening means known in the art. Sealability does not mandate or require but may encompass water or air tight seals, but more typically a hook and loop or zipper style closure may be used to provide a sealable cover. In a number of embodiments, the sealable cover is releasably sealable in that a user can later change the configuration of the internal layers of the mattress. Preferably, the mattress case 20 has interlocking teeth around the perimeter of an opening that seal or unseal the opening when a slide 22 is pulled along the teeth. Although the figures show the mattress case opened by a top flap hingedly connected to one side with the slide on the perimeter of the flap, the invention contemplates other arrangements for positioning the slide and opening of the mattress case. In some embodiments, the mattress case 20 has an open bottom with an elastic band around the perimeter of the open bottom and retains the custom mattress 30 by being pulled over the top of the mattress and stretched to wrap around all sides of the mattress.

Figure 5:
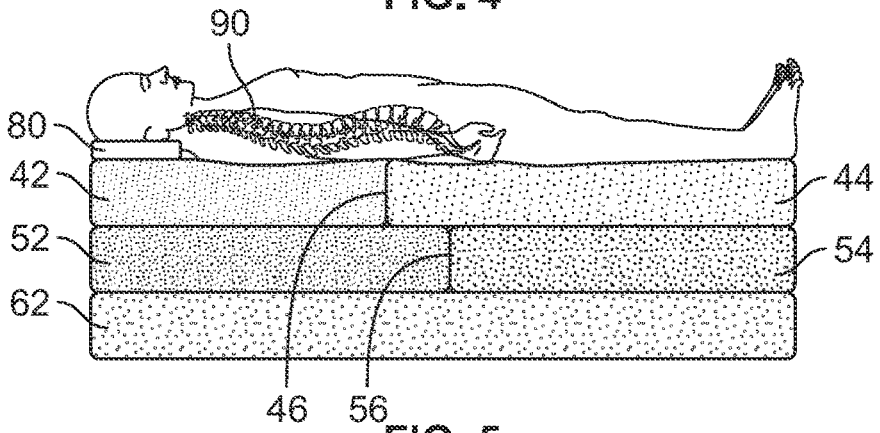
FIG. 5 is a side elevational view of a custom sleep system for a back-sleeping user according to an embodiment of the present invention.
Figure 6:
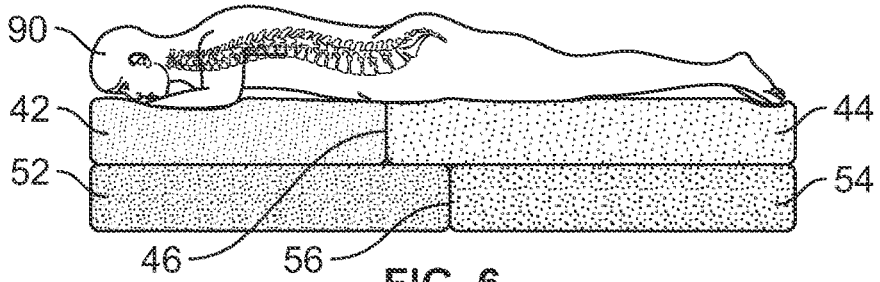
FIG. 6 is a side elevational view of a custom sleep system for a stomach-sleeping user according to an embodiment of the present invention.
Figure 8:
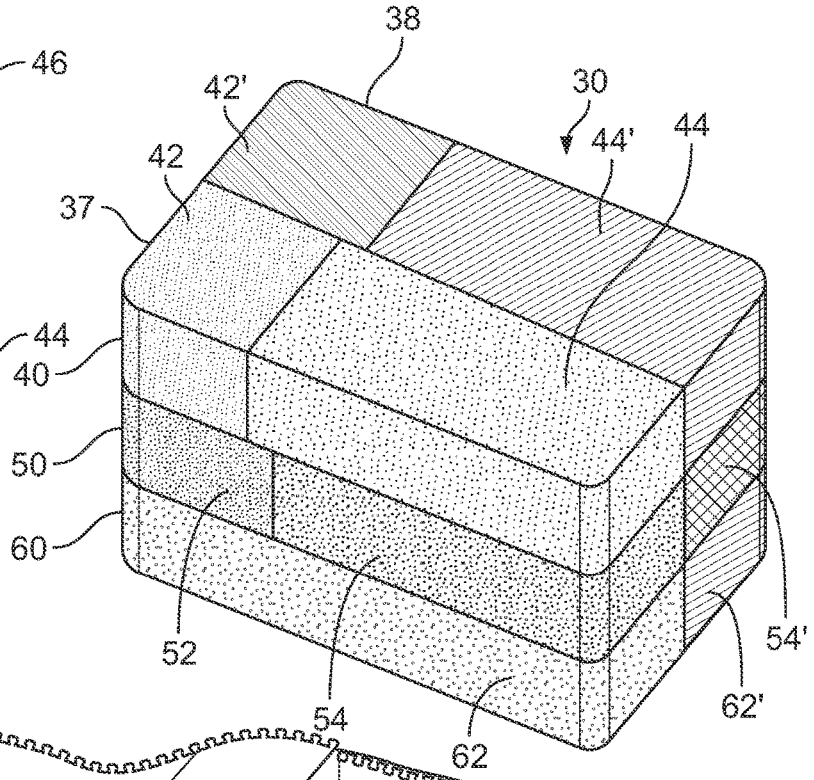
FIG. 8 is a partially exploded view of a custom mattress and mattress cover according to another embodiment of the present invention.
Figure 8:
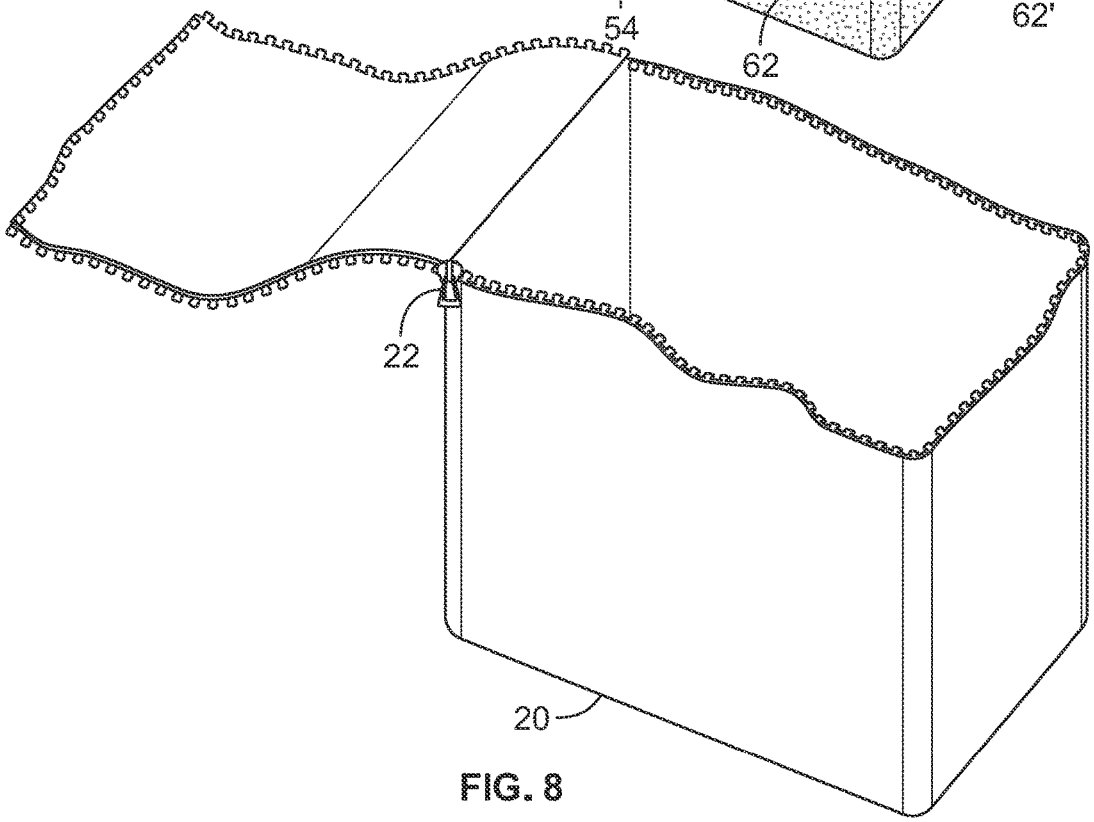

The custom mattress 30 has multiple, separate layers. In preferred embodiments, the mattress 30 has an upper layer 40, a lower layer 50, and a base layer 60. In some embodiments, base layer 60 further includes at least two sub-layers formed of segments 62 and 64. In other embodiments, base layer 60 includes at least one sub-layer formed of segment 62, as shown in FIGS. 5 and 8. In other embodiments, the mattress 30 does not include base layer 60, as shown in FIG. 6. In preferred embodiments, upper layer 40 includes at least two segments 42 and 44, and lower layer 50 includes at least two segments 52 and 54. In some embodiments, upper layer 40 includes at least three segments. In other embodiments, lower layer 50 includes at least three segments. In other embodiments, base layer 60 includes at least two segments.

In yet other embodiments, upper layer 40, lower layer 50, and base layer 60 each include at least two segments.

Preferably, segments 42, 44, 52, 54, 62, and 64 are formed of foam materials and each have different densities and are separately enclosed within respective covers, thus permitting a user to remove and replace any individual segment. For example, if the user's body characteristics change due to injury or weight loss/gain, or if a segment wears out over time, the user can replace any segments to maintain spinal alignment while sleeping. The segments can be formed of a high quality foam material, such as Talalay latex, polyurethane foam, a combination thereof, or any other foam material known in the art. In some embodiments, the segments are of uniform thickness, for example approximately three inches. In preferred embodiments, the segment covers are color-coded to designate segment's respective positioning within the custom mattress 30. For example, the color-coding pattern may follow the visible-light spectrum, with the softest density segment being red, the hardest density segment being violet, and the intermediate density segments having appropriate colors (orange, yellow, green, blue, indigo, etc.), or vice versa. In other embodiments, other physical features are used on the segment covers to distinguish and code the segments. For example, the segment covers could contain different patterns printed on, or embossed in, the material, such as dots on one segment and stripes on another segment. The custom sleep system 10 preferably includes assembly instructions (such as diagrams, text, or a combination thereof) to help a user assemble segments in the appropriate density configuration. The custom sleep system 10 is preferably assembled by stacking the segments in their appropriate configuration within the mattress case 20, which is preferably designed to fully enclose and fit snuggly around the segments such that they cannot shift or become dislodged during use.

Figure 4:
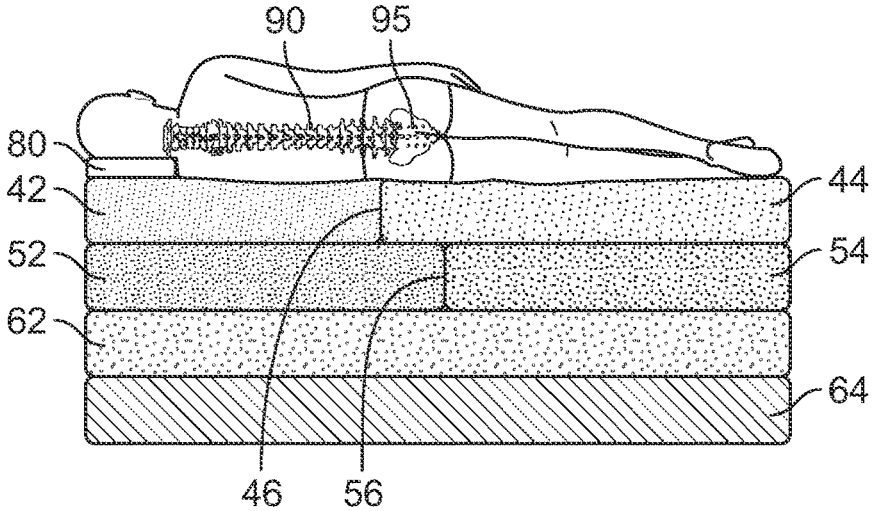
FIG. 4 is a side elevational view of a custom sleep system for a side-sleeping user according to an embodiment of the present invention.

The density of each segment is calculated based on an intended user's body characteristics such that the custom mattress 30 is designed specifically for, and is unique to, that intended user. The custom mattress 30 is designed to enable the user's spine to be in alignment when sleeping in the user's preferred sleep position. FIGS. 4-6 show users sleeping on their custom mattresses 30 in various sleep positions (side, back, and stomach respectively) with their spines 90 in alignment. In some embodiments, the custom sleep system 10 also includes a custom pillow 80, as shown in FIGS. 4 and 5. Pillow 80 is preferably formed of a foam material of a density determined by the intended user's body characteristics and preferred sleep position. For example, pillow 80 designed for a side-sleeper would have a different shape and density than a pillow 80 designed for a back-sleeper. Although FIGS. 4-6 depict mattresses having different amounts of layers, this is not dependent on the user's preferred sleep position. Rather, any amount of layers can be used with any preferred sleep position. Furthermore, embodiments having two layers or less, such as the mattress shown in FIG. 6, can be used as a mattress topper to be placed on top of an existing mattress to create a custom sleep system for situations when the user does not have the option of obtaining a full mattress, such as a college student who is required to sleep on an already-provided dorm room mattress. In some embodiments, the mattress is intended for use as a mattress topper that is formed of one layer having two or more segments of different densities determined by the intended user's body characteristics. Embodiments used as a mattress topper may also include a custom pillow 80.

Figure 10:
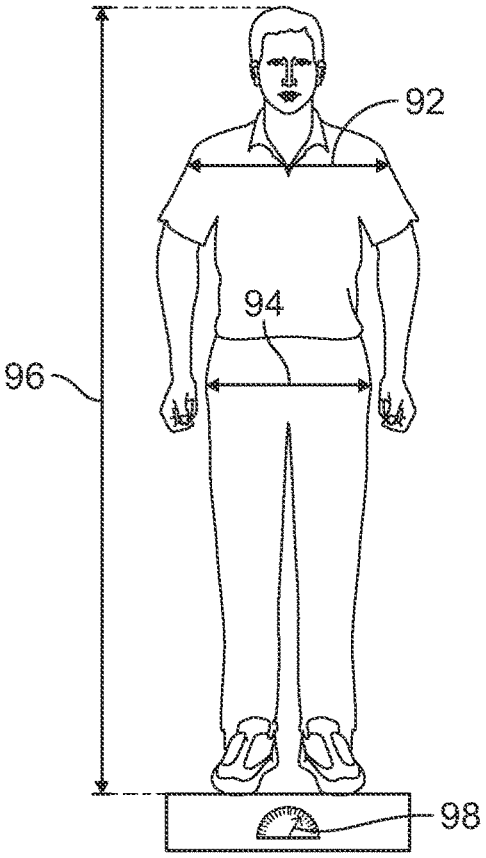
FIG. 10 is a diagrammatic view of the body characteristics required to create a custom mattress for an intended user according to a preferred embodiment of the present invention.

FIG. 10 depicts the body characteristics required to design the custom sleep system 10 for an intended user. In addition to the user's preferred sleep position (side, back, or stomach), the required body characteristics are the user's shoulder width 92, hip width 94, height 96, and weight 98. Preferably, hip width 94 is measured at the widest part of the user's hips, which may be unique to each user. For example, due to general human physiology, the widest part of a male's hips may be located close to the top of his pelvis, while the widest part of a female's hips may be located closer to the bottom of her pelvis. With this body data, the inventors utilize a proprietary algorithm to (1) convert the body data into standardized units of measure across various portions of the mattress surface; (2) translate that data into a series of weight distributions; and (3) specify appropriate mattress foam segments of differing densities as required to achieve the user's spinal alignment. Although this algorithm preferably results in each segment having different densities, the present invention contemplates embodiments where at least two of the segments have the same density, as the densities required to place the user's spine in alignment are determined by the user's unique body characteristics, and thus may not always result in each segment having different densities.

Preferably, segment 42 is positioned at the head of the mattress 32 and segment 44 is positioned adjacent segment 42 along a longitudinal axis of the mattress 34. The location where segment 42 abuts segment 44 creates an upper density transition point 46. The location of the density transition point 46 along the longitudinal axis 34 is determined by the intended user's body characteristics. Preferably, the location of the density transition point 46 is determined by the intended user's height 96, thus the transition point 46 can be referred to as the height dependent density transition point. In preferred embodiments, when the intended user is lying on the mattress in the intended user's preferred sleep position, the density transition point 46 is positioned under an area near the base of the intended user's spine, such as an area between the intended user's bellybutton and pelvis. Thus, the density transition point 46 is preferably located such that segment 42 supports the intended user's upper body (i.e. head and torso) and segment 44 supports the intended user's lower body (i.e. hips and legs).

Figure 3:
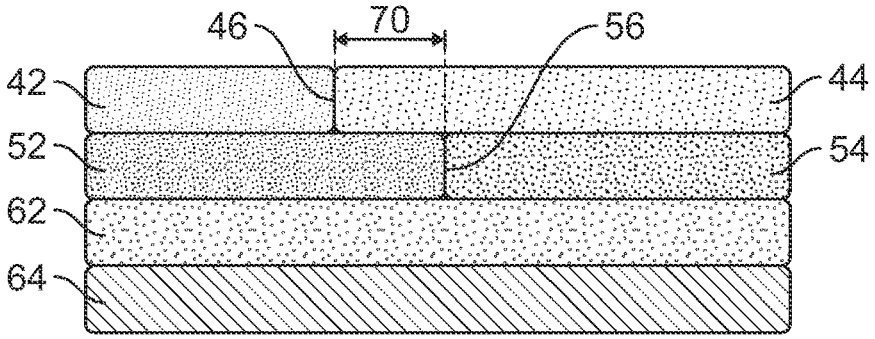
FIG. 3 is a side elevational view of the uncovered custom mattress of FIG. 2.

Similarly, segment 52 is preferably positioned at the head of the mattress 32 and segment 54 is positioned adjacent segment 52 along the longitudinal axis of the mattress 34 to create a lower density transition point 56. As shown in FIG. 3, lower density transition point 56 is offset from upper density transition point 46 a distance 70 measured along the longitudinal axis of the mattress 34. In some embodiments, the offset distance 70 is in the range of about 10% to about 50% of the length of segment 42 measured along longitudinal axis 34, and preferably in the range of about 20% to about 40% of the length of segment 42. In some embodiments, the offset distance 70 is in the range of about 50% to about 100% of the length of the intended user's hip bone 95 measured along longitudinal axis 34, and preferably in the range of about 60% to about 90% of the length of the intended user's hip bone 95. As used herein, the term "about" describing percentage ranges encompasses both the exact percentages named and percentages outside the named range that reasonably account for errors inherent in the manufacturing processes. For example, a range named as about 20% to about 40% can include specifically 20%, specifically 40%, the range of 17%-42%, or even the range of 15%-45%. Similarly, if offset distance 70 is to be 20% of the length of segment 42, which for example is calculated to be five inches (5"), then "about 20%" encompasses specifically five inches and a reasonable range such as plus-or-minus one-half of an inch (i.e. 4.5"-5.5").

Figure 7:
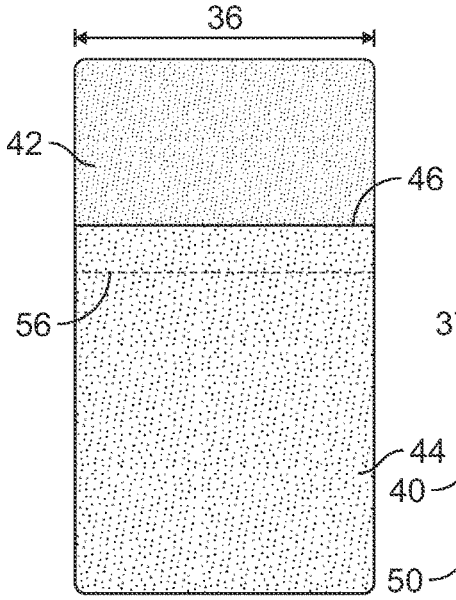
FIG. 7 is a top plan view of the uncovered custom mattress of FIG. 2.

As shown in FIG. 7, density transition points 46/56 span the entire width of the mattress 36. Because the segments 42, 44, 52, and 54 all have different densities calculated based on the intended user's body characteristics, the respective densities of each segment can be arranged to create a gradual density transition between the intended user's upper body and lower body such that the intended user's spine is in alignment when in the preferred sleep position. In preferred embodiments, the segments 42, 44, 52, and 54 have densities ranging from softest to firmest, respectively. In some embodiments, the densities do not follow this softest to firmest pattern. For example, if the intended user is missing a limb or has recently undergone major surgery, the density of some segments may need to be firmer or softer than typically expected.

Figure 9:
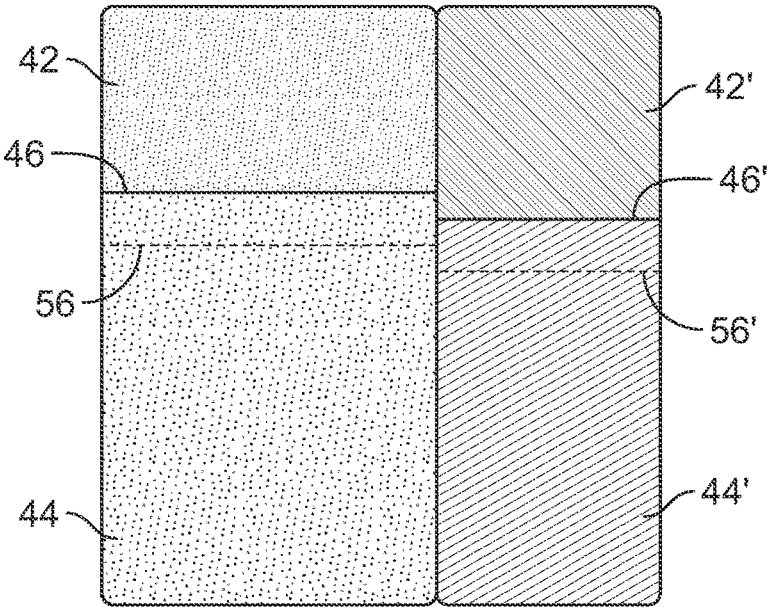
FIG. 9 is a top plan view of the uncovered custom mattress of FIG. 8.

In some embodiments, the custom sleep system 10 includes a mattress 30 designed to support two intended users, each with their own respective lateral section 37/38 of the mattress. Each intended user's lateral section is designed as described above, and the lateral sections are positioned adjacent to each other within the mattress case 20, as shown in FIG. 8. Because each intended user is unique, lateral section 37 preferably has density transition points 46/56 that do not align with density transition points 46'/56' of lateral section 38, as shown in FIG. 9. In some embodiments, the custom sleep system 10 includes a plurality of pillows 80, with at least one pillow designed for the first intended user and at least another pillow designed for the second intended user, as described above. In other embodiments, the custom mattress designed to support two intended users may be used as a mattress topper formed of two lateral sections, each having at least one layer of two or more segments with different densities determined by the intended users' respective body characteristics, as described above. Such custom mattress toppers for multiple users may also include custom pillows 80.

Although the invention has been described with reference to a particular arrangement of parts, features, and the like, and a particular method of assembling these arrangements and features, these are not intended to exhaust all possible arrangements, features, or methods of assembly. Indeed, many other modifications and variations will be ascertainable to those of skill in the art.

What is claimed is:

1. A custom mattress comprising:

an upper layer having two or more segments arranged such that a first segment is positioned at a head of the mattress and a second segment is positioned adjacent the first segment at a first transition point;

a lower layer positioned below and in contact with the upper layer and having two or more segments arranged such that a third segment is positioned at the head of the mattress and a fourth segment is positioned adjacent the third segment at a second transition point that is offset a distance from the first transition, the distance being measured along a longitudinal axis of the mattress;

wherein each of the removable segments has a visual coding thereon, wherein the visual coding is different for removable segments with different densities so that the different densities of the removable segments can be visually identified based on the different visual coding;

wherein the mattress is configured to be arranged adjacent to a second mattress having a second set of segments comprising fifth, sixth, seventh and eighth segments of the second mattress, the fifth and sixth segments being part of the upper layer and the seventh and eighth segments being part of the lower layer and at least two of the second set of segments have different lengths than adjacent ones of the first, second, third and fourth segments of the mattress such that third and fourth transition points are created in the second mattress and these third and fourth transition points are at different locations along the longitudinal axis as compared to the first and second transition points, the mattress and the second mattress being retainable within a sealable case.

2. The custom mattress of claim 1 wherein the mattress is configured to be arranged adjacent to a second mattress having a second set of segments comprising fifth, sixth, seventh and eighth segments of the second mattress, the fifth and sixth segments being part of the upper layer and the seventh and eighth segments being part of the lower layer and at least two of the second set of segments have different lengths than adjacent ones of the first, second, third and fourth segments of the mattress such that third and fourth transition points are created in the second mattress and these third and fourth transition points are at different locations along the longitudinal axis as compared to the first and second transition points, the mattress and the second mattress being retainable within a sealable case.

3. The custom mattress of claim 1 wherein the second set of segments each have different densities and a visual coding thereon wherein the visual coding is different for removable segments with different densities so that the different densities of the removable segments can be visually identified based on the different visual coding.

4. The custom mattress of claim 3 wherein each of the removable segments have different densities and different visual coding.

5. The custom mattress of claim 1 wherein each of the removable segments have different densities and different visual coding.

6. A custom mattress comprising:

an upper layer having two or more segments arranged such that a first segment is positioned at a head of the mattress and a second segment is positioned adjacent the first segment at a first transition point;

a lower layer positioned below and in contact with the upper layer and having two or more segments arranged such that a third segment is positioned at the head of the mattress and a fourth segment is positioned adjacent the third segment at a second transition point that is offset a distance from the first transition, the distance being measured along a longitudinal axis of the mattress;

wherein each of the two or more segments are removable segments and have a visual coding thereon, wherein the visual coding is different for removable segments with different densities so that the different densities of the removable segments can be visually identified based on the different visual coding;

a pillow whose shape and/or density is matched with the first, second, third and fourth removable segments based on a first intended user's sleeping position and body characteristics, the sleeping position being indicative of if the first intended user is a back, belly or side sleeper.

7. The custom mattress of claim 1, further comprising a base layer having at least one removable segment.

8. The custom mattress of claim 6, further comprising a sealable case for retaining the mattress.

9. The custom mattress of claim 6, wherein each of the two or more segments of the upper layer and each of the two or more segments of the lower layer are removable segments and each removable segment has the visual coding thereon and wherein each removable segments is removable with respect to each adjacent removable segment of the removable segments.

10. The custom mattress of claim 6, wherein the positioning of the first and second transition points is determined by a first intended user's sleeping position, and the positioning of the third and fourth transition points is determined by a second intended user's sleeping position.

11. A custom sleep system comprising:

a mattress having first and second lateral sections;

the first lateral section comprising:

a first upper layer having a plurality of removable segments arranged such that a first removable segment is positioned at a head of the mattress and a second removable segment is positioned adjacent the first removable segment at a first transition point determined by a first intended user's body characteristics;

a first lower layer having a plurality of removable segments arranged such that a third removable segment is positioned at the head of the mattress and a fourth removable segment is positioned adjacent the third removable segment at a second transition point that is offset a first distance from the first transition point the second lateral section comprising:

a second upper layer having a plurality of removable segments arranged such that a fifth removable segment is positioned at the head of the mattress and a sixth removable segment is positioned adjacent the fifth removable segment at a third transition point determined by a second intended user's body characteristics;

a second lower layer having a plurality of removable segments arranged such that a seventh removable segment is positioned at the head of the mattress and an eighth removable segment is positioned adjacent the seventh removable segment at a fourth transition point that is offset a second distance from the third transition point; and a sealable case for retaining the mattress;

wherein the first and second distances are each measured along a longitudinal axis of the mattress;

wherein each of the removable segments of the first lateral section of the mattress have different densities that are determined by the first intended user's body characteristics and preferred sleep position, and each of the removable segments of the second lateral section of the mattress have different densities that are determined by the second intended user's body characteristics and preferred sleep position; and a plurality of pillows comprising a first pillow and a second pillow, each of the plurality of pillows is matched to one of the first or second intended user's sleeping position and body characteristics and is further matched to the first or second lateral section such that the first and second pillows respectively correspond to the first and second lateral sections and that the first and second pillows have different densities and/or shapes to match the respective user's body characteristics and sleeping position wherein the sleeping position of each user is selected as one of belly, back or side sleeper.

12. The system of claim 11, wherein the first transition point is at a different location along the longitudinal axis than the third transition point or the second transition point is at a different location along the longitudinal axis than the fourth transition point or the first, second, third and fourth transition points are all located at different locations along the longitudinal axis.

13. The custom sleep system of claim 6, wherein the first lateral section comprises a first base layer having at least one removable segment; and wherein the second lateral section comprises a second base layer having at least one removable segment.

14. A method of providing a custom mattress comprising:

providing a lower foam layer configured for insertion into a case, the lower foam layer having at least a first removable segment configured to be positioned at a head of the case and a second removable segment configured to be located adjacent the first removable segment at a first lower transition point;

providing an upper foam layer configured to be placed onto the lower foam layer, the upper foam layer having at least a third removable segment configured to be positioned at the head of the case and a fourth removable segment configured to be placed adjacent the third removable segment at a first upper transition point;

wherein the first, second, third and fourth removable segments each have a density and length measured along a longitudinal axis of the custom mattress and selected based on a first intended user's intended sleeping position and body characteristics; and providing a custom pillow matched to the lower and upper foam layers based on the first intended user's intended sleeping position and body characteristics wherein the custom pillows has a density and/or shape designed according to the first intended user's body characteristics and preferred sleep position;

providing the case configured to receive and seal around the lower and upper foam layers.

15. The method of claim 14 further comprising each of the removable segments include a visual coding thereon, wherein the visual coding is different for removable segments with different densities so that the different densities of the removable segments can be visually identified based on the different visual coding.

16. The method of claim 15 wherein the different visual coding includes a different color.

17. The method of claim 14 further comprising:

providing a second lower foam layer configured for insertion into a case adjacent the lower foam layer, the second lower foam layer having at least a fifth removable segment configured to be positioned at a head of the case and a sixth removable segment configured to be located adjacent the fifth removable segment at a second lower transition point;

providing a second upper foam layer configured to be placed onto the second lower foam layer adjacent the upper foam layer, the second upper foam layer having at least a seventh removable segment configured to be positioned at the head of the case and an eighth removable segment configured to be placed adjacent the seventh removable segment at a second upper transition point;

wherein the fifth, sixth, seventh and eighth removable segments each have a density and length measured along a longitudinal axis of the custom mattress and selected based on a second intended user's intended sleeping position and body characteristics; and providing a second custom pillow matched to the second lower and second upper foam layers based on the second intended user's intended sleeping position and body characteristics wherein the custom pillows has a density and/or shape designed according to the second intended user's body characteristics and preferred sleep position and is different from the custom pillow.

18. The method of claim 17 further comprising each of the removable segments include a visual coding thereon, wherein the visual coding is different for removable segments with different densities so that the different densities of the removable segments can be visually identified based on the different visual coding.

* * * * *